US011759666B1

(12) United States Patent
Liu

(10) Patent No.: US 11,759,666 B1
(45) Date of Patent: Sep. 19, 2023

(54) ADJUSTABLE HEIGHT BALANCE BEAM

(71) Applicant: Yanshan Fitting Sport Equipment Manufacturing co., Ltd, Hebei (CN)

(72) Inventor: Qiangsong Liu, Hebei (CN)

( * ) Notice: Subject to any disclaimer, the term of this patent is extended or adjusted under 35 U.S.C. 154(b) by 0 days.

(21) Appl. No.: 18/068,623

(22) Filed: Dec. 20, 2022

(51) Int. Cl.
*A63B 4/00* (2006.01)

(52) U.S. Cl.
CPC ..... *A63B 4/00* (2013.01); *A63B 2225/093* (2013.01)

(58) Field of Classification Search
CPC . A63B 4/00; A63B 21/00047; A63B 21/0005; A63B 21/00054; A63B 21/078; A63B 21/4027; A63B 21/4029; A63B 22/0046; A63B 26/00; A63B 26/003; A63B 71/0036; A63B 2210/00; A63B 2210/50; A63B 2225/09; A63B 2225/093
See application file for complete search history.

(56) References Cited

U.S. PATENT DOCUMENTS 3,404,884 A * 10/1968 Sorenson ..... A63B 4/00 254/8 R
3,510,129 A * 5/1970 Reuther ..... A63B 4/00 108/147.22
3,990,697 A * 11/1976 Reuther ..... A63B 4/00 482/34
4,143,602 A * 3/1979 Brunn ..... A47B 9/16 108/117
4,148,264 A * 4/1979 Caravias ..... A47B 3/00 108/69
4,365,801 A * 12/1982 Medina ..... A63B 4/00 434/247
5,037,086 A * 8/1991 Strand ..... A63B 4/00 248/560
5,069,447 A * 12/1991 Snyderman ..... A63B 21/078 482/133
5,082,259 A * 1/1992 Gonzalez ..... A63B 23/0355 482/142
5,232,426 A * 8/1993 Van Straaten ..... A63B 21/4029 482/130
5,637,059 A * 6/1997 Dalebout ..... A63B 21/4029 482/52
D907,144 S * 1/2021 Zhao ..... A63B 4/00 D21/690
2006/0122045 A1* 6/2006 Webber ..... A63B 21/4029 482/142
2008/0248937 A1* 10/2008 Stillwell ..... A63B 21/4029 482/145
2017/0216656 A1* 8/2017 Leipheimer ..... A63B 69/0057
2019/0240527 A1* 8/2019 Hsieh ..... A63B 21/4047
2020/0078627 A1* 3/2020 Landsman ..... A63B 4/00
2022/0176190 A1* 6/2022 Pena ..... A63B 22/0235

* cited by examiner

*Primary Examiner* — Gary D Urbiel Goldner

(57) ABSTRACT

An adjustable height balance beam includes a beam having a first part, a second part, and a middle part connected between the first part and the second part; a first supporter configured to connect and support the first part; and a second supporter configured to connect and support the second part. Each of the first supporter and the second supporter includes a connection element connected to the beam, a support element pivotably connected to an end of the connection element and having a plurality of fixing portions along an extending direction of the support element, and an adjustable element having a first end pivotably connected to another end of the connection element and a second end configured to be detachably connected with the plurality of fixing portions so as to adjust a height of the beam.

20 Claims, 6 Drawing Sheets

ADJUSTABLE HEIGHT BALANCE BEAM

TECHNICAL FIELD

The present disclosure relates to the technical field of exercise equipment, in particular, to an adjustable height balance beam.

BACKGROUND

Balance beams are widely known pieces of exercise equipment most commonly used in connection with gymnastics. An existing balance beam has a linear double-pipe height adjustment mode, it is hard to adjust a height and a height of a single pope only can be adjusted to 30 cm, 35 cm, 40 cm or 45 cm. Further, the existing balance beam also has the problem of swaying from side to side, causing low security.

SUMMARY

In order to overcome the shortcomings in the existing balance beam, the present disclosure provides an adjustable height balance beam.

The present disclosure also adopts the following technical solution: an adjustable height balance beam comprising a beam including a first part, a second part, and a middle part connected between the first part and the second part; a first supporter configured to connect and support the first part; a second supporter configured to connect and support the second part; wherein each of the first supporter and the second supporter includes a connection element connected to the beam, a support element pivotably connected to an end of the connection element and including a plurality of fixing portions along an extending direction of the support element, and an adjustable element including a first end pivotably connected to another end of the connection element and a second end configured to be detachably connected with the plurality of fixing portions so as to adjust a height of the beam.

Further, the connection element includes a first connection plate fixed on a bottom surface of the beam and two first side plates facing each other and vertically connected to the first connection plate, each first side plate includes a first pivot hole, a first shaft passes through the first pivot holes of the two first side plates and at least one second pivot hole of the first end of the adjustable element so as to pivotably connect the connection element and the first end of the adjustable element.

Further, the first connection plate includes a plurality of first fixing holes, a plurality of first fixing elements pass through the plurality of first fixing holes respectively and insert into the beam so as to fix the connection element on the bottom surface of the beam.

Further, the adjustable element includes a second connection plate and two second side plates facing each other and vertically connected to the second connection plate, each second side plate includes a second pivot hole, the first end of the adjustable element is located between the two first side plates of the connection element and each second side plate abuts a corresponding one first side plate, the first shaft passes through the first pivot holes of the two first side plates and the two second pivot holes of the two second side plates so as to pivotably connect the connection element and the first end of the adjustable element.

Further, the first shaft is a first screw including a first head and a first shaft portion connected with the first head, a first nut is fixed on an end of the first shaft portion far away from the first head.

Further, the support element includes a third connection plate and two third side plates facing each other and vertically connected to the third connection plate, each third side plate includes a third pivot hole, a second shaft passes through the third pivot holes of the two third side plates and fourth pivot holes of the first side plates of the connection element so as to pivotably connect the connection element and the support element, the adjustable element includes a fixing shaft passing through the two third side plates, the fixing shaft is configured to be fixed in the plurality of fixing portions so as to detachably connect to the support element, and an end surface of each of two second side plates at the second end of the adjustable element are arc-shaped and abuts the third connection plate.

Further, the second shaft is a second screw including a second head and a second shaft portion connected with the second head, a second nut is fixed on an end of the second shaft portion far away from the second head.

Further, the two second side plates are located between the two third side plates, and each second side plate abuts a corresponding one third side plate.

Further, the adjustable element includes a gasket welded on the third side plate, and the fixing shaft passes through the gasket and the two third side plates and fixed at the fixing portion.

Further, two locking members are disposed at two opposite ends of the fixing shaft and sandwich the two third side plates; an outer surface of the fixing shaft has outer threads, and the two locking members includes inner threads cooperating with the outer threads so as to fix the second end of the adjustable element and the support element.

Further, when the adjustable height balance beam is in a support state, the fixing shaft is fixed at the plurality of fixing portions, such that the height of the adjustable height balance beam can be adjusted to 30 cm, 35 cm, 40 cm or 50 cm.

Further, the fixing portions are a plurality of third fixing holes passing through the two third side plates.

Further, the plurality of fixing portions are a plurality of notches located on an edge of the two third side plates far away from the third connection plate.

Further, the plurality of notches includes a first notch adjacent to the beam, a second notch far away from the first notch and a plurality of third notches located between the first notch and the second notch, the first notch, the second notch and the plurality of third notches are strip-shaped, an extending direction of the first notch and an extending direction of the second notch are vertical relative to the extending direction of the support element, the plurality of third notches each have a same extending direction that is inclined relative to the extending direction of the support element.

Further, when the adjustable height balance beam is in a folding state, the fixing shaft is located at the second notch, the support element with the adjustable element can rotate about the connection element so as to locate between the two first side plates, and the current height of the adjustable height balance beam includes the height of the beam and a height of the connection element.

Further, each of the first supporter and the second supporter further includes a support shaft connected with an end of the support element far away from the beam in a supporting state, an extending direction of the support shaft is substantially perpendicular to an extending direction of the beam.

Further, the support element further includes a connection portion respectively connected substantially perpendicular with the third connection plate and two third side plates, the connection portion includes at least one second fixing hole, at least one second fixing element passes through the at least one second fixing hole and inserts into the support shaft.

Further, the support shaft includes a main body and a deslicking material layer located at an outer surface of the main body Further, each third side plate includes a bottom end surface, the bottom end surface is arc-shaped and abuts an outer surface of the support shaft.

Further, the support shaft includes a first portion, a second portion, and a middle portion connected between the first portion and the second portion, the end the support element far away from the beam in the supporting state is connected with the middle portion, a diameter of the first portion is equal to a diameter of the second portion and greater than a diameter of the middle portion.

Further, each of an outer surface of the first portion and an outer surface of the second portion has a plurality of stripe projections, an extending direction of the stripe projection is a same as the extending direction of the support shaft, and the plurality of stripe projections are arranged around the extending direction of the support shaft.

Further, each of the first supporter and the second supporter further includes a strengthening element, the strengthening element includes a fourth connection plate facing with the third connection plate and two fourth side plates facing each other and respectively connected substantially perpendicular with the fourth connection plate, the two third side plates are located between the two fourth side plates and abut against the two fourth side plates.

The present disclosure has the beneficial effects: the second end of the support element can be detachably connected with the plurality of fixing portions so as to adjust the height of the beam easily for users, even children. Furthermore, in the support state, the connection element, the support element and the adjustable element form a triangle shaped structure to support the beam stably, such that user experience of the adjustable height balance beam can be improved.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
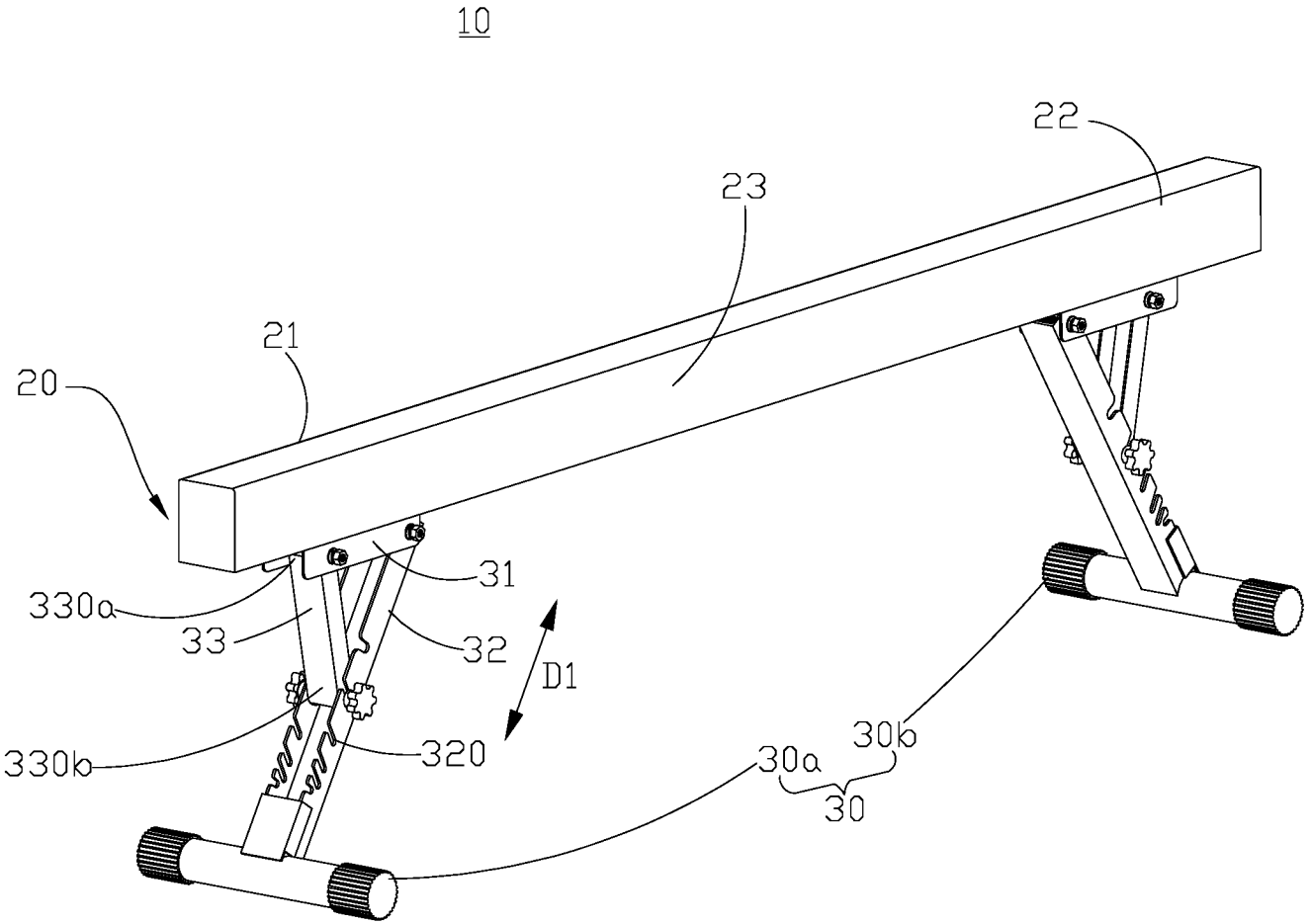
FIG. 1 is a schematic view of an adjustable height balance beam according to a first embodiment of the present disclosure in a support state.
Figure 2:
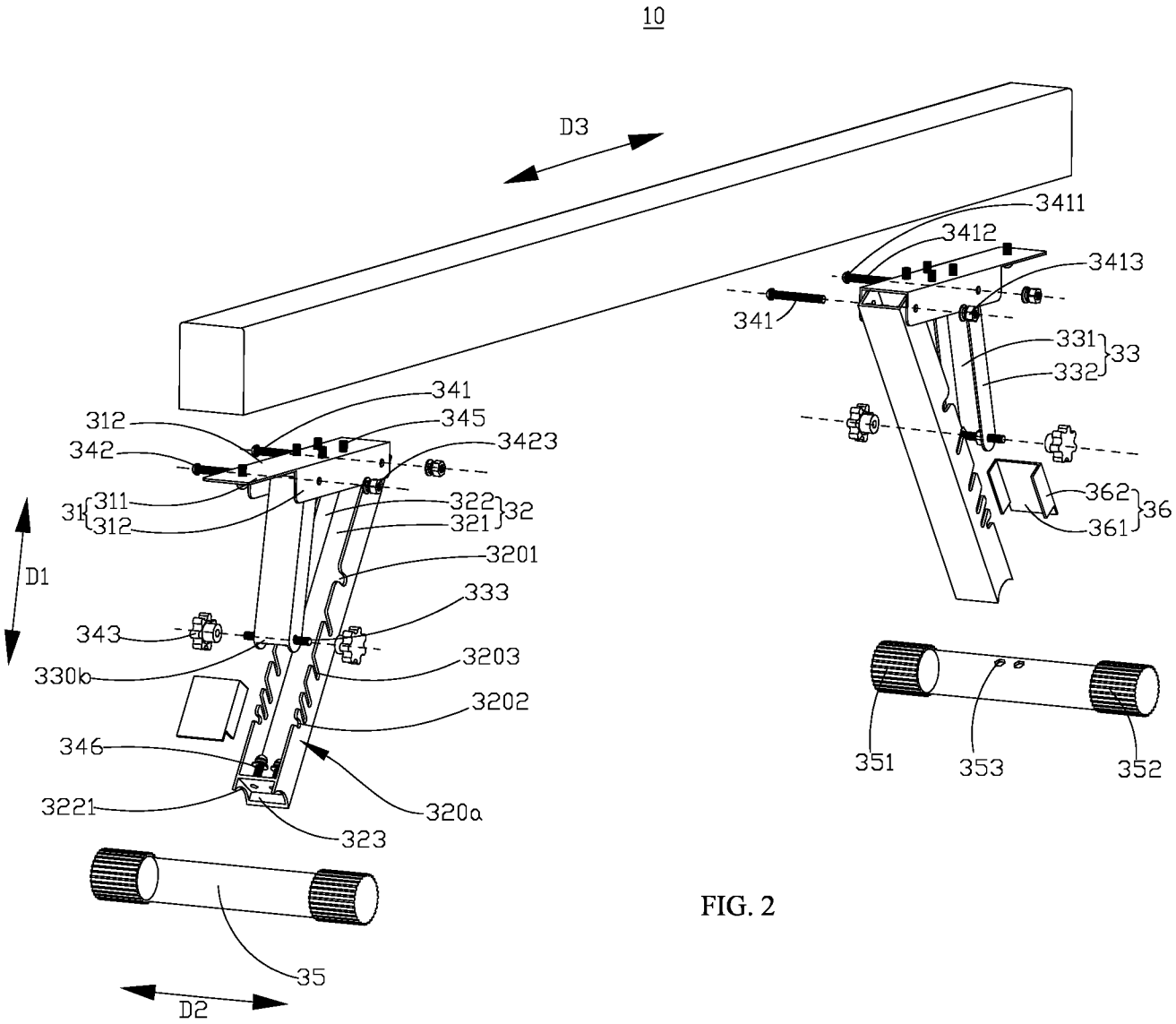
FIG. 2 is an exposed view of the adjustable height balance beam according to the first embodiment of the present disclosure.
Figure 3:
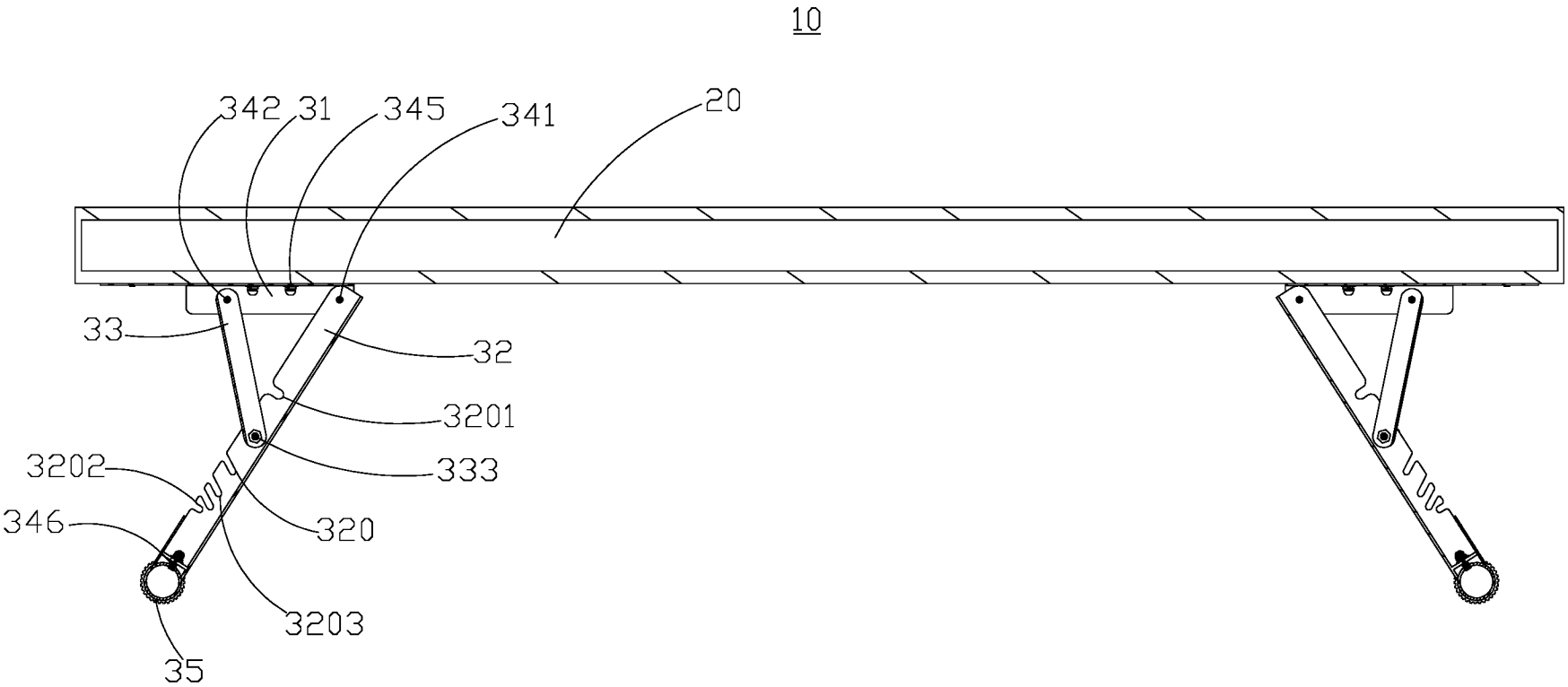
FIG. 3 is a cross-section view of the adjustable height balance beam according to the first embodiment of the present disclosure in the support state.
Figure 4:
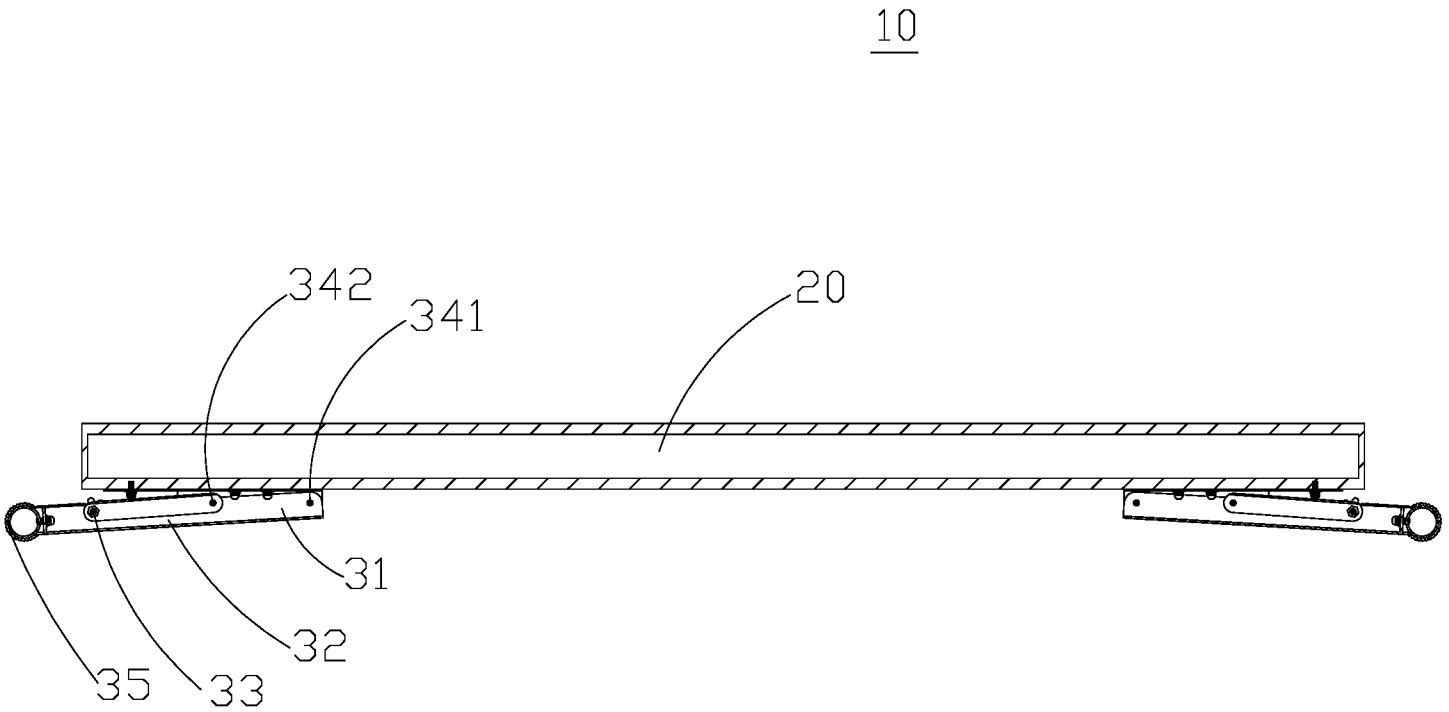
FIG. 4 is a cross-section view of the adjustable height balance beam according to the first embodiment of the present disclosure in a folding state.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Referring to FIG. 1~FIG. 4, a first embodiment of the present disclosure provides an adjustable height balance beam 10. The adjustable height balance beam 10 includes a beam 20, a first supporter 30*a* and a second supporter 30*b*. The beam 20 includes a first part 21, a second part 22, and a middle part 23 connected between the first part 21 and the second part 22. The first supporter 30*a* is configured to connect and support the first part 21. The second supporter 30*b* is configured to connect and support the second part 22. Each of the first supporter 30*a* and the second supporter 30*b* includes a connection element 31, a support element 32 and an adjustable element 33. The connection element 31 is connected to the beam 20. The support element 32 is pivotably connected to an end of the connection element 31 and includes a plurality of fixing portions 320 along an extending direction D1 of the support element 32, and The adjustable element 33 includes a first end 330*a* pivotably connected to another end of the connection element 31 and a second end 330*b* configured to be detachably connected with the plurality of fixing portions 320 so as to adjust a height of the beam 20.

In the adjustable height balance beam 10, the second end 330*b* of the support element 32 can be detachably connected with the plurality of fixing portions 320 so as to adjust the height of the beam 20 easily for users, even children. Furthermore, in the support state, the connection element 31, the support element 32 and the adjustable element 33 form a triangle shaped structure to support the beam 20 stably, such that user experience of the adjustable height balance beam 10 can be improved.

In the embodiment, the connection element 31 includes a first connection plate 311 fixed on a bottom surface of the beam 20 and two first side plates 312 facing each other and respectively connected substantially perpendicular to the first connection plate 311, each first side plate 311 includes a first pivot hole, a first shaft 341 passes through the first pivot holes of the two first side plates 312 and at least one second pivot hole of the first end 330*a* of the adjustable element so as to pivotably connect the connection element 31 and the first end 330*a* of the adjustable element.

The first connection plate 311 includes a plurality of first fixing holes, a plurality of first fixing elements 345 pass through the plurality of first fixing holes respectively and insert into the beam 20 so as to fix the connection element 31 on the bottom surface of the beam 20. The plurality of first fixing elements 345 can be screws, and the number of the plurality of first fixing elements 345 may be four or five. By means of the first fixing elements 345, it is easy to assemble the connection element 31 with the beam 20. The first connection plate 311 is applied and fixed on the bottom surface of the beam 20, a contact area of the first connection plate 311 and the beam is large, such that a stably of the adjustable height balance beam 10 can be improved.

The adjustable element 33 includes a second connection plate 331 and two second side plates 332 facing each other and respectively connected substantially perpendicular to the second connection plate 331, each second side plate 332 includes the second pivot hole, the two second side plates 332 of the first ends 330*a* are located between the two first side plates 312 and each second side plate 332 abuts a corresponding one the first side plates 312 to increase support stability of the support element 32. The first shaft 341 passes through the first pivot holes of the two first side plates 312 and the two second pivot holes of the two second side plates 332 so as to pivotably connect the connection element 31 and the first end 330*a*.

In the embodiment, the first shaft 341 is a first screw having a first head 3411 and a first shaft portion 3412 connected with the first head 3411, a first nut 3413 is fixed on an end of the first shaft portion 3412 far away from the first head 3411.

The support element 32 includes a third connection plate 321 and two third side plates 322 facing each other and respectively connected substantially perpendicular to the third connection plate 321, each third side plate 322 includes a third pivot hole, a second shaft 342 passes through the third pivot holes of the two third side plates 322 and fourth pivot holes of the first side plates 312 of the connection element 31 so as to pivotably connect the connection element 31 and the support element 32, the plurality of fixing portions 320 are a plurality of notches 320*a* located on an edge of the two third side plates 322 far away from the third connection plate 321. The two third side plates 322 are located between the two first side plates 312 in the support state. Each third side plate 322 abuts a corresponding one the first side plates 312 to increase support stability of the support element 32.

The adjustable element 33 includes a fixing shaft 333 passing through the two third side plates 322, the fixing shaft 333 is configured to be fixed in the different notches 320*a* so as to detachably connect to the support element 32, and an end surface of each of two second side plates at the second end of the adjustable element are arc-shaped and abuts the third connection plate 321. The two second side plates 332 are located between the two third side plates 322 in the support state. Each second side plate 332 abuts a corresponding one the third side plates 322 to increase support stability of the support element 32.

The second shaft 342 is a second screw having a second head and a second shaft portion connected with the second head, a second nut 3423 is fixed on an end of the second shaft portion far away from the second head.

Two locking members 343 are disposed at two opposite ends of the fixing shaft 333 and sandwich the two third side plates 322; an outer surface of the fixing shaft 333 has outer threads, and the two locking members 343 includes inner threads cooperating with the outer threads so as to fix the second end 330*b* of the adjustable element and the support element 32.

The plurality of notches 320*a* includes a first notch 3201 adjacent to the beam 20, a second notch 3202 far away from the first notch 3201 and a plurality of third notches 3203 located between the first notch 3201 and the second notch 3202. The first notch 3201, the second notch 3202 and the plurality of third notches 3203 are strip-shaped, an extending direction of the first notch 3201 and an extending direction of the second notch 3202 are vertical relative to the extending direction D1 of the support element 32, the plurality of third notches 3203 each have a same extending direction that is inclined relative to the extending direction D1 of the support element 32.

Each of the first supporter 30*a* and the second supporter 30*b* further includes a support shaft 35 connected with an end of the support element 32 far away from the beam 20 in a supporting state, an extending direction D2 of the support shaft 35 is vertical to an extending direction D3 of the beam 20.

The support element 32 further includes a connection portion 323 substantially perpendicular with the third connection plate 321 and two third side plates 322, the connection portion 323 includes at least one second fixing hole, at least one second fixing element 346 passes through the at least one second fixing hole and inserts into the support shaft 35.

Each third side plate 322 includes a bottom end surface 3221, the bottom end surface 3221 is arc-shaped and abuts an outer surface of the support shaft 35 to increase stability of the support element 32.

The support shaft 35 includes a first portion 351, a second portion 352, and a middle portion 353 connected between the first portion 351 and the second portion 352, the end the support element 32 far away from the beam 20 in the supporting state is connected with the middle portion 353. The first portion 351, the second portion 352, and the middle portion 353 are cylindrical shaped and a diameter of the first portion 351 is equal to a diameter of the second portion 352 and greater than a diameter of the middle portion 353.

Each of an outer surface of the first portion 351 and an outer surface of the second portion 352 has a plurality of stripe projections 353, an extending direction of the stripe projection 353 is a same as the extending direction D2 of the support shaft 35, and the plurality of stripe projections 353 are arranged around the extending direction D2 of the support shaft 35.

Each of the first supporter 30*a* and the second supporter 30*b* further includes a strengthening element 36, the strengthening element 36 includes a fourth connection plate 361 facing with the third connection plate 321 and two fourth side plates 362 facing each other and respectively connected substantially perpendicular with the fourth connection plate 361, and the two third side plates 322 are located between the two fourth side plates 362 and abut against the two fourth side plates 362. By means of the strengthening element 36, the support stability of the support element 32 can be increased.

When the adjustable height balance beam 10 is in the folding state, the fixing shaft 333 is located at the second notch 3202, the support element 32 with the adjustable element 33 can rotate about the connection element 31 so as to locate between the two first side plates, and the current height of the adjustable height balance beam 10 includes the height of the beam 20 and a height of the connection element 31. The height of the beam 20 is about 5 cm, the height of the connection element 31 is about 1 cm, such that, the current height of the adjustable height balance beam 10 can be about 6 cm. Furthermore, when the adjustable height balance beam 10 is in support state, the fixing shaft 333 can be located at one of the third notches 3203 and the first notch 3201, such that the height of the adjustable height balance beam 10 can be adjusted to 30 cm, 35 cm, 40 cm or 50 cm.

Figure 5:
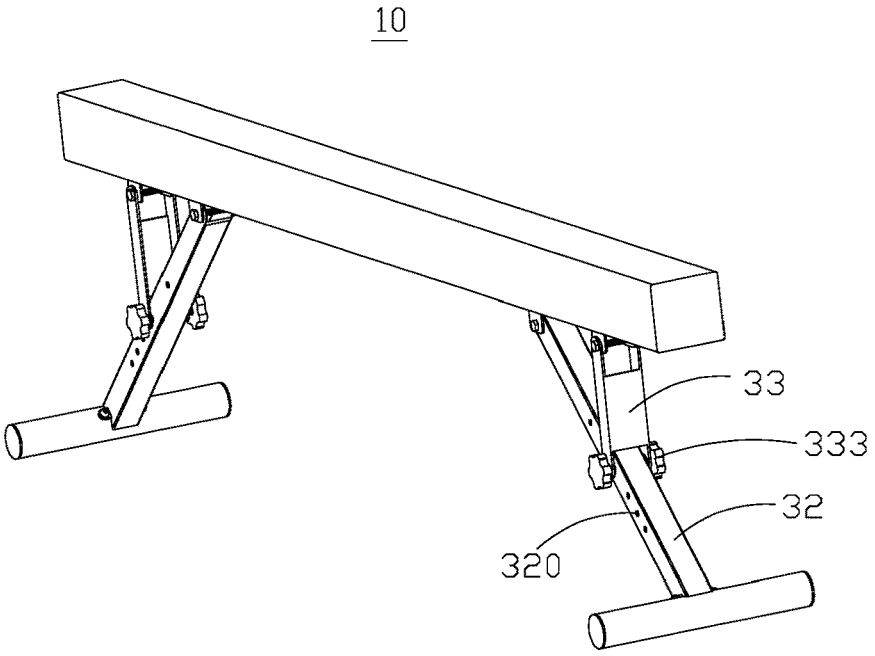
FIG. 5 is a schematic view of an adjustable height balance beam according to a second embodiment of the present disclosure in a support state.
Figure 6:
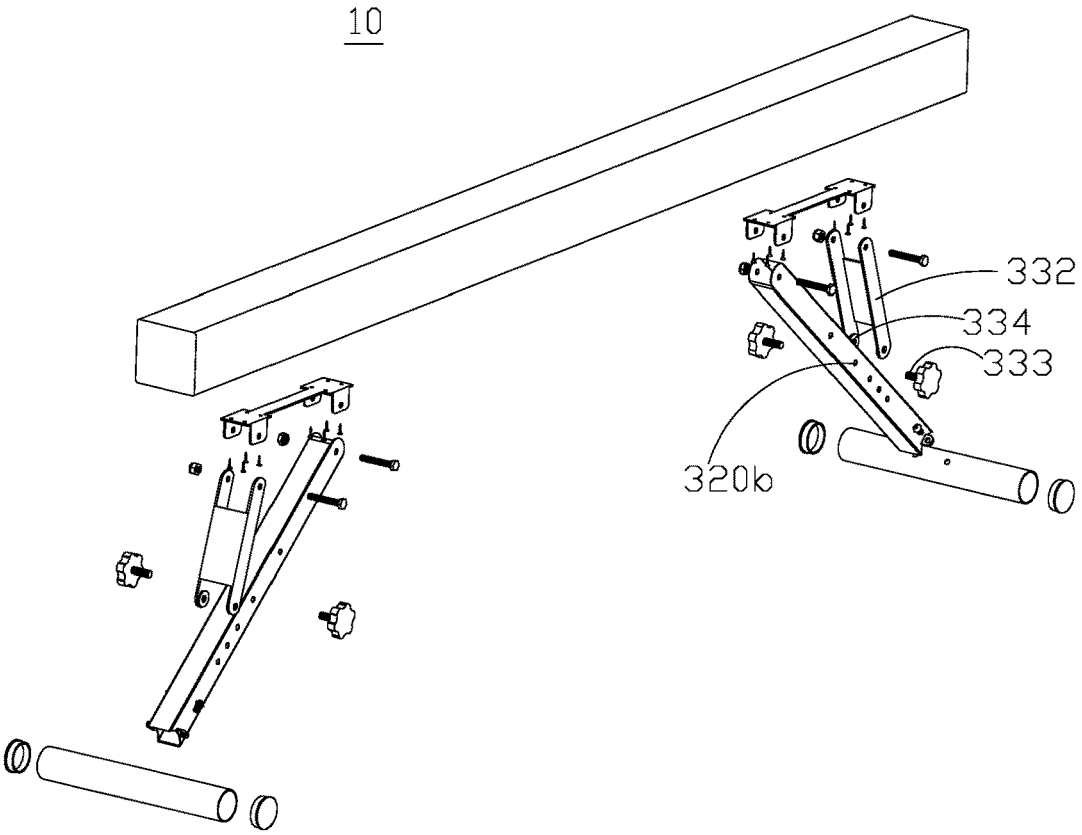
FIG. 6 is an exposed view of the adjustable height balance beam according to the second embodiment of the present disclosure.

Referring to FIG. 5~FIG. 6, the present disclosure further includes a second embodiment. The adjustable height balance beam 10 of the second embodiment is basically same with the telescopic bendable support structure of the first embodiment. That is, the description of the telescopic bendable support structure of the first embodiment is basically applicable to the seventh embodiment. The following will combine with FIG. 5~FIG. 6 to illustrate differences between the adjustable height balance beam 10 of the second embodiment and the adjustable height balance beam 10 of the first embodiment.

In the second embodiment, the fixing portions 320 are a plurality of third fixing holes 320*b*, the adjustable element 33 includes first and second gaskets 334 respectively welded onto the two second side plates 332, and first and second fixing shafts 333 respectively pass through the first and second gaskets 334 and the two third side plates 322 and are fixed at different third fixing holes 320*b*. In doing so, the first and second fixing shafts 333 detachably connect the adjustable element 33 to the support element 32 to selectively adjust a height of the beam 10.

Figure 7:
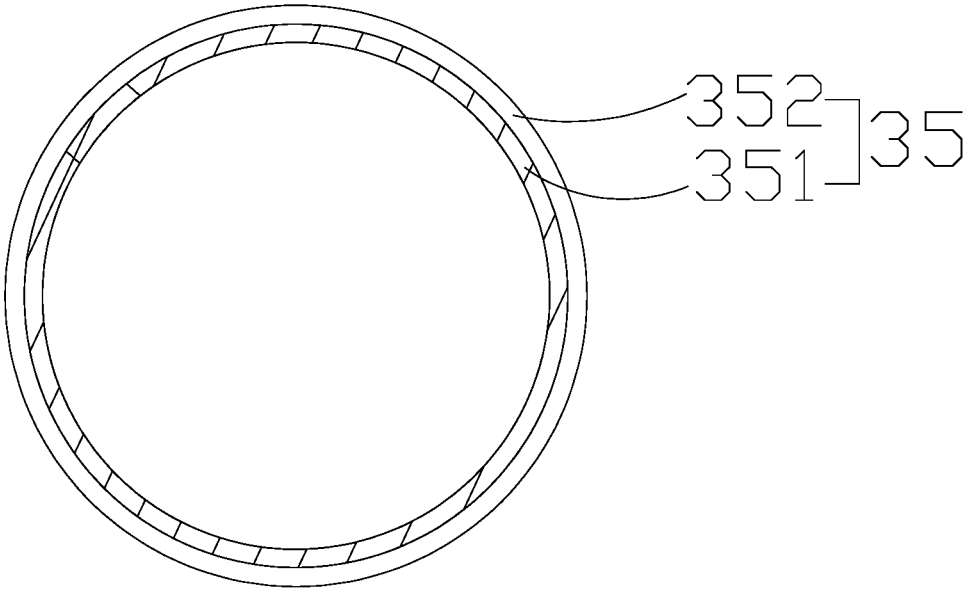
FIG. 7 is a cross-section view of a support shaft of the adjustable height balance beam according to the second embodiment of the present disclosure.

Referring to FIG. 7, the support shaft 35 may include a main body 351 and a deslicking material layer 352 located at an outer surface of the main body 351.

The above description only describes embodiments of the present disclosure, and is not intended to limit the present disclosure, various modifications and changes can be made to the present disclosure. Any modifications, equivalent substitutions, improvements, etc. made within the spirit and scope of the present disclosure are intended to be included within the scope of the present disclosure.

What is claimed is:

1. An adjustable height balance beam, comprising:

a beam comprising a first part, a second part, and a middle part connected between the first part and the second part;

a first supporter configured to connect and support the first part;

a second supporter configured to connect and support the second part;

wherein each of the first supporter and the second supporter comprises a connection element connected to the beam, a support element pivotably connected to an end of the connection element and comprising a plurality of fixing portions along an extending direction of the support element, and an adjustable element comprising a first end pivotably connected to another end of the connection element and a second end configured to be detachably connected with the plurality of fixing portions so as to adjust a height of the beam.

2. The adjustable height balance beam according to claim 1, wherein the connection element comprises a first connection plate fixed on a bottom surface of the beam and two first side plates facing each other and vertically connected to the first connection plate, each first side plate comprises a first pivot hole, wherein a first shaft passes through the first pivot holes of the two first side plates and at least one second pivot hole of the first end of the adjustable element so as to pivotably connect the connection element and the first end of the adjustable element.

3. The adjustable height balance beam according to claim 2, wherein the first connection plate comprises a plurality of first fixing holes, a plurality of first fixing elements pass through the plurality of first fixing holes respectively and insert into the beam so as to fix the connection element on the bottom surface of the beam.

4. The adjustable height balance beam according to claim 2, wherein the adjustable element comprises a second connection plate and two second side plates facing each other and connected substantially perpendicular to the second connection plate, each second side plate comprises one of the at least one second pivot holes, the first end of the adjustable element is located between the two first side plates of the connection element and each second side plate abuts a corresponding one first side plate, the first shaft passes through the first pivot holes of the two first side plates and the two second pivot holes of the two second side plates so as to pivotably connect the connection element and the first end of the adjustable element.

5. The adjustable height balance beam according to claim 4, wherein the first shaft is a first screw comprising a first head and a first shaft portion connected with the first head, a first nut is fixed on an end of the first shaft portion far away from the first head.

6. The adjustable height balance beam according to claim 4, wherein the support element comprises a third connection plate and two third side plates facing each other and connected substantially perpendicular to the third connection plate, each third side plate comprises a third pivot hole, wherein a second shaft passes through the third pivot holes of the two third side plates and fourth pivot holes of the first side plates of the connection element so as to pivotably connect the connection element and the support element, the adjustable element comprises a fixing shaft passing through the two second side plates, the fixing shaft is configured to be fixed in the plurality of fixing portions so as to detachably connect to the support element, and an end surface of each of the two second side plates at the second end of the adjustable element is arc-shaped and abuts the third connection plate.

7. The adjustable height balance beam according to claim 6, wherein the second shaft is a second screw comprising a second head and a second shaft portion connected with the second head, a second nut is fixed on an end of the second shaft portion far away from the second head.

8. The adjustable height balance beam according to claim 6, wherein two locking members are disposed at two opposite ends of the fixing shaft and sandwich the two third side plates; an outer surface of the fixing shaft has outer threads, and the two locking members comprise inner threads cooperating with the outer threads so as to fix the second end of the adjustable element and the support element.

9. The adjustable height balance beam according to claim 6, wherein when the adjustable height balance beam is in a support state, the fixing shaft is selectively fixed in one of the plurality of fixing portions, such that the height of the adjustable height balance beam can be adjusted to 30 cm, 35 cm, 40 cm or 50 cm.

10. The adjustable height balance beam according to claim 6, wherein the plurality of fixing portions are a plurality of fixing holes.

11. The adjustable height balance beam according to claim 6, wherein the plurality of fixing portions are a plurality of notches located on an edge of each of the two third side plates far away from the third connection plate.

12. The adjustable height balance beam according to claim 11, wherein the plurality of notches comprises a first notch adjacent to the beam, a second notch far away from the first notch and a plurality of third notches located between the first notch and the second notch, the first notch, the second notch and the plurality of third notches are strip-shaped, an extending direction of the first notch and an extending direction of the second notch are vertical relative to the extending direction of the support element, the plurality of third notches each have a same extending direction that is inclined relative to the extending direction of the support element.

13. The adjustable height balance beam according to claim 12, wherein when the adjustable height balance beam is in a folding state, the fixing shaft is located at the second notch, the support element with the adjustable element can rotate about the connection element so as to locate between the two first side plates, and a current height of the adjustable height balance beam includes the height of the beam and a height of the connection element.

14. The adjustable height balance beam according to claim 6, wherein each of the first supporter and the second supporter further comprises a support shaft connected with an end of the support element far away from the beam in a supporting state, an extending direction of the support shaft is substantially perpendicular to an extending direction of the beam.

15. The adjustable height balance beam according to claim 14, wherein the support element further comprises a connection portion connected substantially perpendicular with each of the third connection plate and the two third side plates, the connection portion comprises at least one fixing hole, at least one fixing element passes through the at least one fixing hole and inserts into the support shaft.

16. The adjustable height balance beam according to claim 14, wherein each third side plate comprises a bottom end surface, the bottom end surface is arc-shaped and abuts an outer surface of the support shaft; and the support shaft comprises a main body and a deslicking material layer located at an outer surface of the main body.

17. The adjustable height balance beam according to claim 14, wherein the support shaft comprises a first portion, a second portion, and a middle portion connected between the first portion and the second portion, the end the support element far away from the beam in the supporting state is connected with the middle portion, a diameter of the first portion is equal to a diameter of the second portion and greater than a diameter of the middle portion.

18. The adjustable height balance beam according to claim 17, wherein each of an outer surface of the first portion and an outer surface of the second portion has a plurality of stripe projections, an extending direction of the stripe projection is a same as the extending direction of the support shaft, and the plurality of stripe projections are arranged around the extending direction of the support shaft.

19. The adjustable height balance beam according to claim 14, wherein each of the first supporter and the second supporter further comprises a strengthening element, the strengthening element comprises a fourth connection plate facing the third connection plate and two fourth side plates facing each other and respectively connected substantially perpendicular with the fourth connection plate, the two third side plates are located between the two fourth side plates and abut against the two fourth side plates.

20. The adjustable height balance beam according to claim 4, wherein the connection element further comprises a second two first side plates facing each other and vertically connected to the first connection plate, the second two first side plates being disposed at the end of the connection element and the two first side plates being disposed at said another end of the connection element;

wherein the support element comprises a third connection plate and two third side plates facing each other and connected substantially perpendicular to the third connection plate, each third side plate comprises a third pivot hole;

wherein a second shaft passes through the third pivot holes of the two third side plates and fourth pivot holes of the second two first side plates of the connection element so as to pivotably connect the connection element and the support element;

wherein an end surface of each of the two second side plates at the second end of the adjustable element is arc-shaped, and the two third side plates are located between and respectively abutting the two second side plates of the adjustable element;

wherein the adjustable element further comprises first and second fixing shafts and first and second gaskets, the first and second gaskets are respectively welded onto the two second side plates at the second end of the adjustable element, the first and second fixing shafts respectively pass through the first and second gaskets and the corresponding two third side plates and are selectively fixed in a respective one of the plurality of fixing portions so as to detachably connect the adjustment element to the support element.

* * * * *